US010448475B2

(12) United States Patent
Chin et al.

(10) Patent No.: US 10,448,475 B2
(45) Date of Patent: Oct. 15, 2019

(54) DRIVING CIRCUIT AND ILLUMINATION DEVICE

(71) Applicant: SILICON TOUCH TECHNOLOGY INC., Hsinchu (TW)

(72) Inventors: Chi-Yuan Chin, Hsinchu (TW); Kuei-Jyun Chen, Hsinchu (TW)

(73) Assignee: SILICON TOUCH TECHNOLOGY INC., Hsinchu (TW)

( * ) Notice: Subject to any disclaimer, the term of this patent is extended or adjusted under 35 U.S.C. 154(b) by 0 days.

(21) Appl. No.: 15/864,423

(22) Filed: Jan. 8, 2018

(65) Prior Publication Data

US 2018/0302968 A1 Oct. 18, 2018

(30) Foreign Application Priority Data

Apr. 12, 2017 (TW) ..... 106112207 A

(51) Int. Cl.
*H05B 37/02* (2006.01)
*H05B 33/08* (2006.01)

(52) U.S. Cl.
CPC ..... *H05B 33/0851* (2013.01)

(58) Field of Classification Search
CPC ..... H05B 33/0851
USPC ..... 315/185 R, 291, 307, 308
See application file for complete search history.

(56) References Cited

U.S. PATENT DOCUMENTS

2009/0015172 A1* 1/2009 Huang ..... H05B 33/0818 315/246
2009/0128045 A1* 5/2009 Szczeszynski ..... H05B 33/0815 315/185 R
2011/0037410 A1* 2/2011 Hsu ..... H05B 33/0815 315/294
2014/0292228 A1 10/2014 Lin
2015/0022103 A1* 1/2015 Kao ..... H05B 33/0815 315/192
2015/0076999 A1* 3/2015 Malinin ..... H05B 33/0815 315/186

FOREIGN PATENT DOCUMENTS

CN 101835301 A 9/2010
CN 203590545 U 5/2014
TW I404455 B1 8/2013
TW M461277 U1 9/2013

(Continued)

*Primary Examiner* — Thuy V Tran
(74) *Attorney, Agent, or Firm* — Li & Cai Intellectual Property (USA) Office

(57) ABSTRACT

A driving circuit for driving a light emitting diode module includes: a control module; a driving module electrically connected to the control module and the light emitting diode module for providing a plurality of driving signals to drive the light emitting diode module; and a detecting module electrically connected to the light emitting diode and the control module, the detecting module detecting a voltage or a current of the light emitting diode module and transmitting a detecting signal corresponding to the voltage or the current of the light emitting diode module to the control module. The control module adjusts a waveform of at least one driving signal of the driving signals for driving the light emitting diode module to illuminate uniformly at a driving time interval of the at least one driving signal of the driving signals.

7 Claims, 6 Drawing Sheets

(56) References Cited

FOREIGN PATENT DOCUMENTS

| | | | |
|---|---|---|---|
| TW | I438742 | | 5/2014 |
| TW | I465151 | B | 12/2014 |
| TW | M499728 | U | 4/2015 |
| TW | 201524260 | A | 6/2015 |
| WO | WO 2016128716 | A1 | 8/2016 |

* cited by examiner

DRIVING CIRCUIT AND ILLUMINATION DEVICE

BACKGROUND

1. Technical Field

The present disclosure relates to an illumination device, to an illumination device compensating the waveform of the driving signal.

2. Description of Related Art

With the gradual development of the micro-LED technology, LED display devices are on a par with LCD display devices. However, because the electrical characteristics of light-emitting diodes and liquid crystal molecules are different, conventional LED display devices have some disadvantages in terms of the brightness control.

Therefore, how to provide a light emitting diode display device that illuminates uniformly in each control signal is an important issue in the industry.

SUMMARY

In order to achieve the above purposes, the present disclosure provides a driving circuit for driving a light emitting diode module which includes: a control module; a driving module electrically connected to the control module and the light emitting diode module for providing a plurality of driving signals to drive the light emitting diode module; and a detecting module electrically connected to the light emitting diode and the control module, the detecting module detecting a voltage or a current of the light emitting diode module and transmitting a detecting signal corresponding the voltage or the current of the light emitting diode module to the control module. The control module adjusts a waveform of at least one driving signal of the driving signals for driving the light emitting diode module to illuminate uniformly at a driving time interval of the at least one driving signal of the driving signals.

In order to achieve the above purposes, the present disclosure provides an illumination device which includes: a light emitting diode module; a control module; a driving module electrically connected to the control module and the light emitting diode module for providing a plurality of driving signals to drive the light emitting diode module; and a detecting module electrically connected to the light emitting diode and the control module, the detecting module detecting a voltage or a current of the light emitting diode module and transmitting a detecting signal corresponding the voltage or the current of the light emitting diode module to the control module. The control module adjusts a waveform of at least one driving signal of the driving signals for driving the light emitting diode module to illuminate uniformly at a driving time interval of the at least one driving signal of the driving signals.

According to the above, the driving circuit of the present disclosure detects the voltage and the current of the light emitting diode module, and provides a detecting signal based on the voltage and the current of the light emitting diode module. The control module adjusts the driving signal based on the detecting signals to enable the light emitting diode module, the light emitting diode group of the light emitting diode or the light emitting diode of the light emitting diode group to illuminate uniformly. Consequently, the control precision of the light emitting diode device can be enhanced, and the LED display device has better performance under different brightness.

In order to further understand the techniques, means and effects of the instant disclosure, the following detailed descriptions and appterminaled drawings are hereby referred to, such that, and through which, the purposes, features and aspects of the instant disclosure can be thoroughly and concretely appreciated; however, the appterminaled drawings are merely provided for reference and illustration, without any intention to be used for limiting the instant disclosure.

BRIEF DESCRIPTION OF THE DRAWINGS

The accompanying drawings are included to provide a further understanding of the instant disclosure, and are incorporated in and constitute a part of this specification. The drawings illustrate exemplary embodiments of the instant disclosure and, together with the description, serve to explain the principles of the present disclosure.

DESCRIPTION OF THE EXEMPLARY EMBODIMENTS

Figure 1:
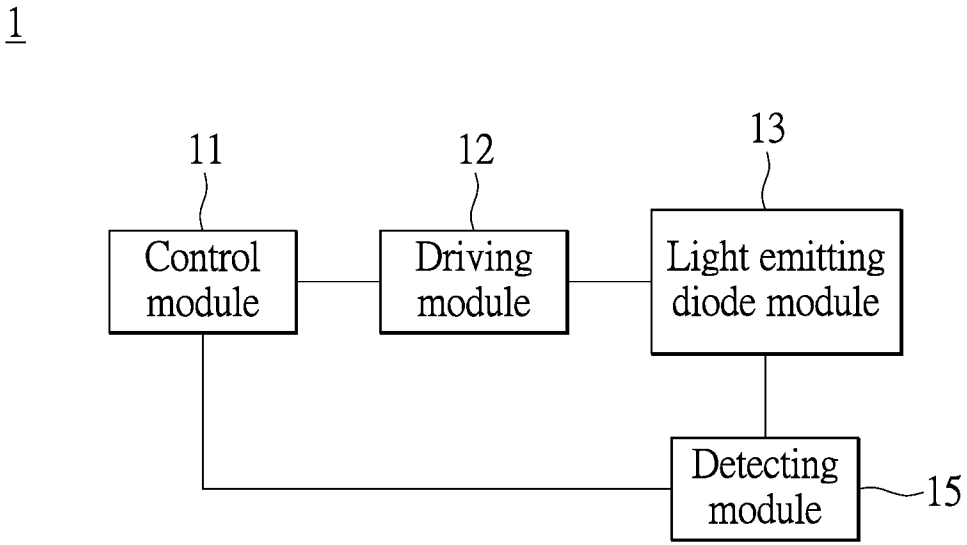
FIG. 1 is a schematic diagram of an illumination device of the embodiment of the present disclosure.

Reference will now be made in detail to the exemplary embodiments of the instant disclosure, examples of which are illustrated in the accompanying drawings. Wherever possible, the same reference numbers are used in the drawings and the description to refer to the same or like parts.

[The Embodiment of the Driving Circuit]

Referring to FIG. 1, FIG. 1 is a schematic diagram of an illumination device of the embodiment of the present disclosure.

The illumination device includes a control module 11, a driving module 12, a light emitting diode module 13 and a detecting module 15.

The control module 11 is electrically connected to the driving module 12. The driving module 12 is electrically connected to the light emitting diode module 13 and provides a plurality of driving signals to the light emitting diode module 13 for driving the light emitting diode module 13. In the present embodiment, the driving signals include a plurality of square voltage waves or a plurality of square current waves for driving the light emitting diode module 13, which is not limited in the present disclosure. In the present embodiment, each square wave is considered as a driving signal, namely, the driving signals include a plurality of the square waves. In other embodiments, the driving signal is a triangular wave or a specific wave, such as a sinusoidal periodic wave or a stepped wave including a fixed slew rate, which is not limited in the present disclosure.

The detecting module 15 is electrically connected to the light emitting diode module 13 and the control module 11. The detecting module 15 is used for detecting a voltage or a current of the light emitting diode module 13, and transforming the voltage or the current of the light emitting diode module 13 into a detecting signal corresponding thereto. The detecting module 15 transmits the detecting signals to the control module 11.

According to the resistive character of the light emitting diode module 13, the voltage driving signals or the current driving signals are distorted when the voltage driving signals or the current driving signals are transmitted through the light emitting diode module 13. The control module 11 can adjust the waveform of one driving signal, and the light emitting diode module 13 can uniformly illuminate at a driving time interval T of one driving signal. In the present embodiment, the driving signals are pulse width modulation signals. Therefore, the driving time intervals of the driving signals are different from each other.

Figure 2A:
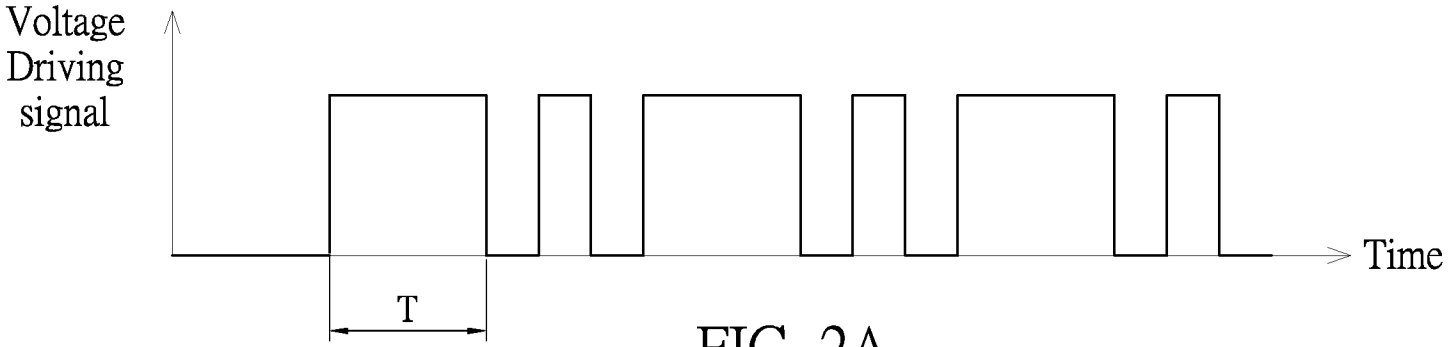
FIG. 2A is a schematic diagram of the driving signals of the embodiment of the present disclosure.
Figure 2B:
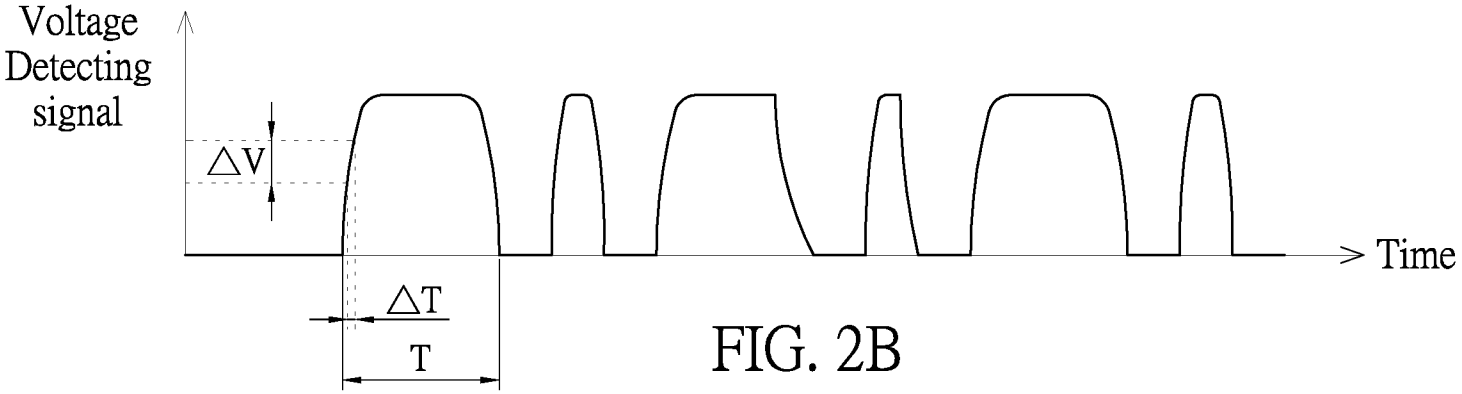
FIG. 2B is a schematic diagram of the detecting signals of the embodiment of the present disclosure.
Figure 3:
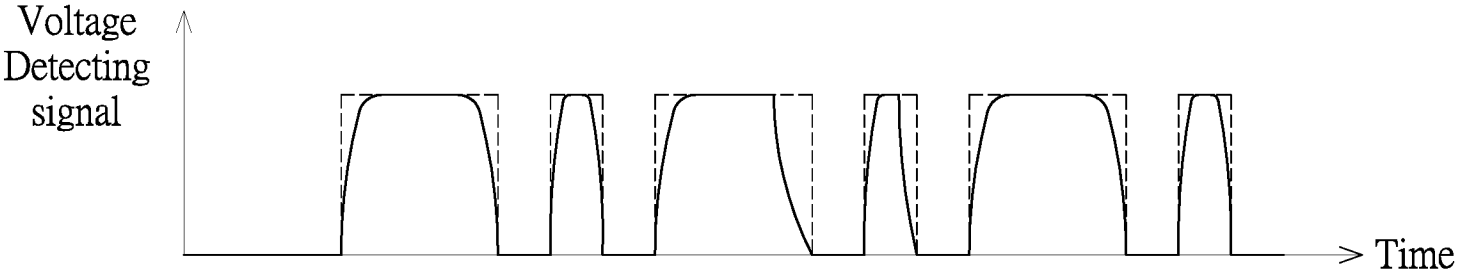
FIG. 3 is a schematic diagram of the compensated detecting signals of the embodiment of the present disclosure.

Referring to FIG. 2A, FIG. 2B and FIG. 3, FIG. 2A is a schematic diagram of the driving signals of the embodiment of the present disclosure, FIG. 2B is a schematic diagram of the detecting signals of the embodiment of the present disclosure, and FIG. 3 is a schematic diagram of the compensated detecting signals of the embodiment of the present disclosure.

The waveform of the driving signals in FIG. 2A is the driving signals that are not compensated. The waveform of the detecting signals in FIG. 2B is the detecting signals that are not compensated. As shown in FIG. 2A, the driving signals are square waves, and are distorted according to the resistive character of the light emitting diode module 13. In the present embodiment, the distortion of the waveform in FIG. 2B denotes that the brightness of the light emitting diode module 13 at the driving time interval does not illuminate uniformly.

In the present embodiment, the detecting module 15 detects a voltage difference or a current difference at a predetermined time interval ΔT. In FIG. 2A and FIG. 2B, the voltage difference is taken as an example. In the present embodiment, the predetermined time interval ΔT is one picosecond or a number of microseconds. The predetermined time interval ΔT can be set by a timing unit (not shown) included in the detecting module 15, which is not limited in the present disclosure.

The detecting module 15 provides a detecting signal to the control module 11 based on the voltage difference or the current difference at the predetermined time interval ΔT. In the present embodiment, the detecting module 15 provides the voltage difference at the driving time interval ΔT or the current difference at the driving time interval ΔT to the control module 11, namely, the voltage of one side of the light emitting diode module 13 at each time interval or the current through the light emitting module 13 at each time interval is transmitted to the control module 11. The control module 11 adjusts the corresponding waveform of the driving signal, so that the voltage waveform or the current waveform of the light emitting diode module 13 detected by the detecting module 15 can be shown as the square waveforms represented by the dotted lines in FIG. 3.

[Another Embodiment of the Driving Circuit]

Figure 4:
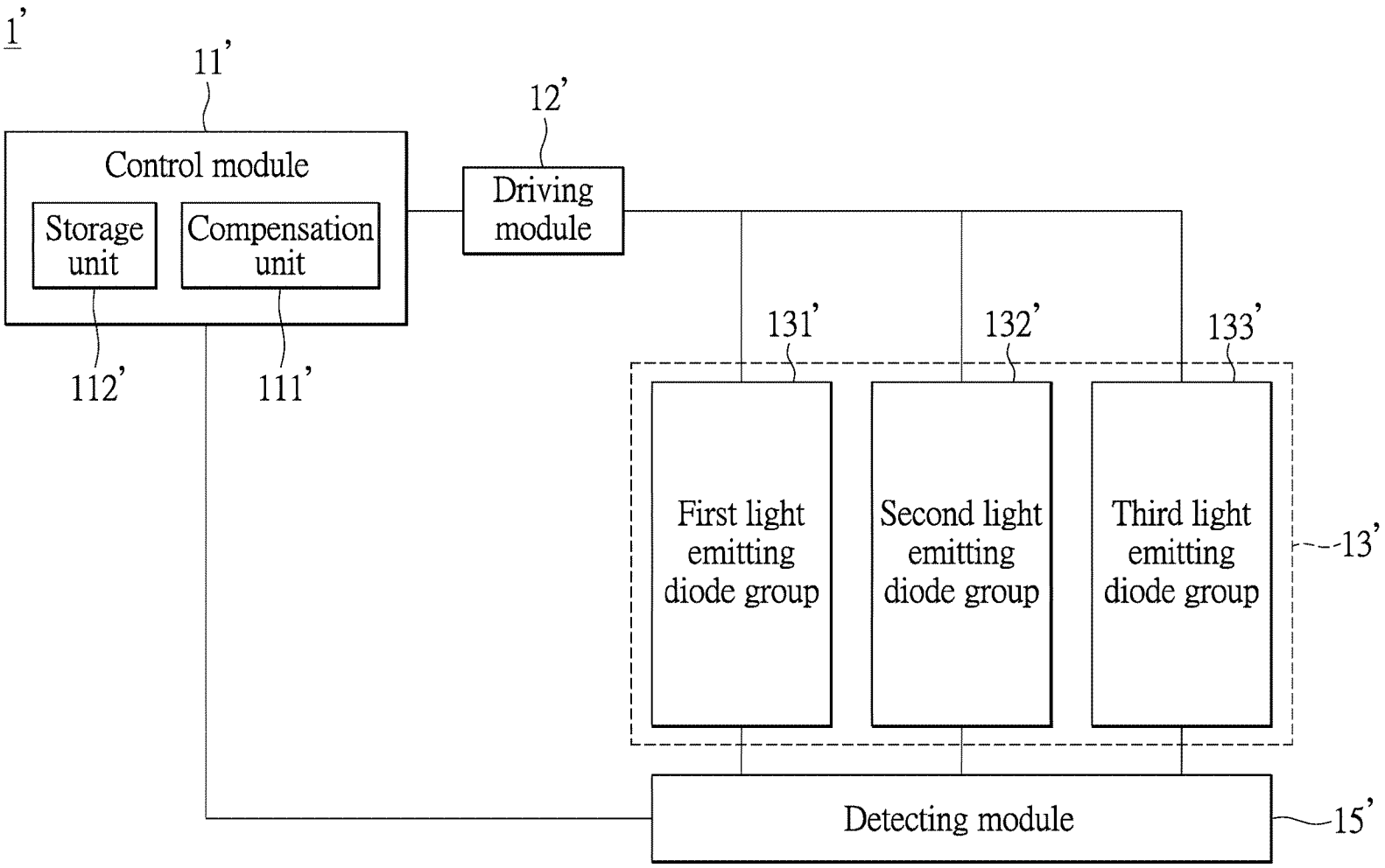
FIG. 4 is another schematic diagram of an illumination device of the embodiment of the present disclosure.

Referring to FIG. 4, FIG. 4 is another schematic diagram of an illumination device of the embodiment of the present disclosure.

The illumination device 1' includes a control module 11', a driving module 12', a light emitting diode module 13' and a detecting module 15'.

The control module 11' is electrically connected to the driving module 12'. The driving module 12' is electrically connected to the light emitting diode module 13' and provides a plurality of driving signals to the light emitting diode module 13' for driving the light emitting diode module 13'. In the present embodiment, the driving signals includes a plurality of square voltage waves or a plurality of square current waves for driving the light emitting diode module 13', which is not limited in the present disclosure. In the present embodiment, each square wave is considered as a driving signal, namely, the driving signals includes a plurality of the square waves.

The detecting module 15' is electrically connected to the light emitting diode module 13' and the control module 11'. The detecting module 15' is used for detecting a voltage or a current of the light emitting diode module 13', and transforming the voltage or the current of the light emitting diode module 13' into a detecting signal corresponding thereto. The detecting module 15' transmits the detecting signals to the control module 11'.

In the present embodiment, the light emitting diode module 13' further includes a first light emitting diode group 131', a second light emitting diode group 132' and a third light emitting diode group 133'. The first light emitting diode group 131', the second light emitting diode group 132' and the third light emitting diode group 133' respectively include a plurality of light emitting diodes (not shown). The numbers of the light emitting diodes (not shown) of the first light emitting diode group 131', the second light emitting diode group 132' and the third light emitting diode group 133' are not limited in the present disclosure. In addition, the number of the light emitting diode group is variable according to practical requests, which is not limited in the present disclosure.

According to their respective resistive characters of the first light emitting diode group 131', the second light emitting diode group 132' and the third light emitting diode group 133' of the light emitting diode module 13', the voltage driving signals or the current driving signals of the first light emitting diode group 131', the second light emitting diode group 132' and the third light emitting diode group 133' are distorted when the voltage driving signals or the current driving signals are transmitted through the first light emitting diode group 131', the second light emitting diode group 132' and the third light emitting diode group 133' of the light emitting diode module 13'.

The control module 11' can adjust the waveform of one driving signal of the light emitting diode module 13', and the light emitting diode module 13' can uniformly illuminate at a driving time interval T of one driving signal. In the present embodiment, the driving module 12' respectively provides three driving signals to the first light emitting diode group 131', the second light emitting diode group 132' and the third light emitting diode group 133'. The detecting module 15' respectively detects the voltage or the current of the first light emitting diode group 131', the second light emitting diode group 132' and the third light emitting diode group 133' to transform them into a first detecting signal of the first light emitting diode group 131', a second detecting signal of the second light emitting diode group 132' and a third detecting signal of the third light emitting diode group 133' for providing those detecting signals to the control module 11'. A compensation unit 111' of the control module 11' respectively provides a first compensation parameter, a second compensation parameter and a third compensation parameter to the control module 11' based on the first detecting signal of the first light emitting diode group 131', the second detecting signal of the second light emitting diode group 132' and the third detecting signal of the third light emitting diode group 133'. The control module 11' adjusts the driving signals provided to the first light emitting diode group 131', the second light emitting diode group 132' and the third light emitting diode group 133' based on the compensation parameters.

In the present embodiment, the first compensation parameter includes a compensation parameter corresponding to one driving signal of the first light emitting diode group 131'. In other words, the first compensation parameter is generated based on each driving signal and the corresponding detecting signal. In the present embodiment, the first compensation parameter, the second compensation parameter and the third compensation parameter are generated through a linear algorithm or a nonlinear algorithm, which is not limited in the present disclosure.

In addition, the control module 11' further includes a storage unit 112' for storing the first compensation parameter, the second compensation parameter and the third compensation parameter.

Figure 5A:
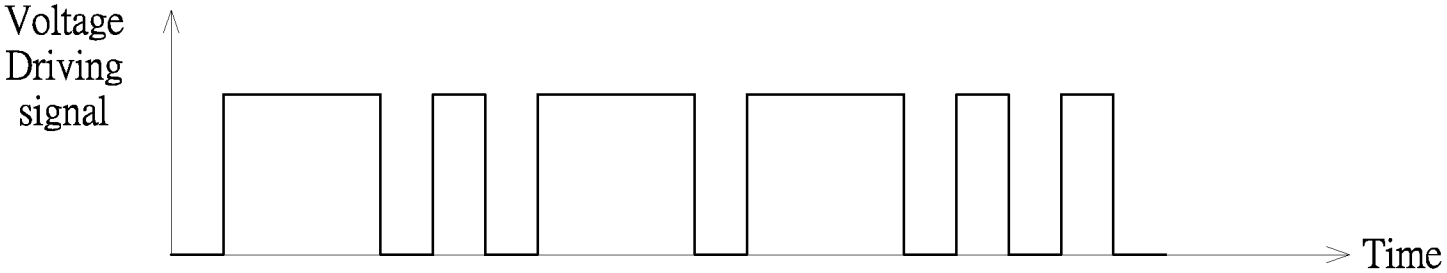
FIG. 5A is a schematic diagram of the driving signals of a first light emitting diode group of the embodiment of the present disclosure.
Figure 5B:
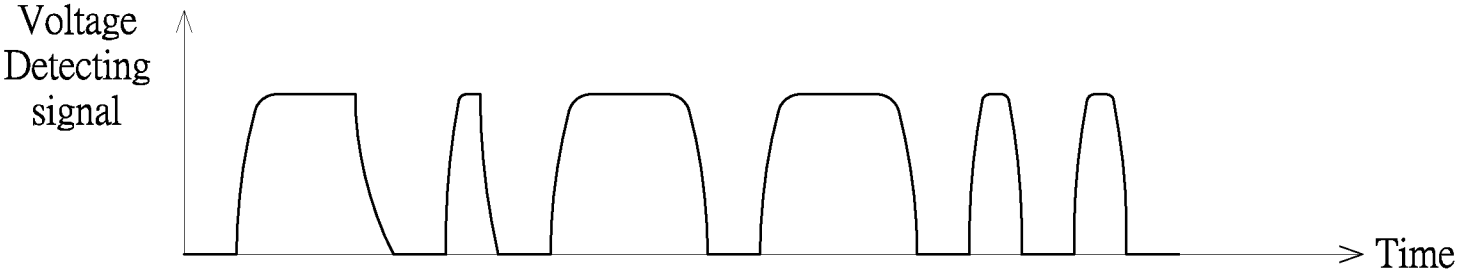
FIG. 5B is a schematic diagram of the detecting signals of a first light emitting diode group of the embodiment of the present disclosure.
Figure 6:
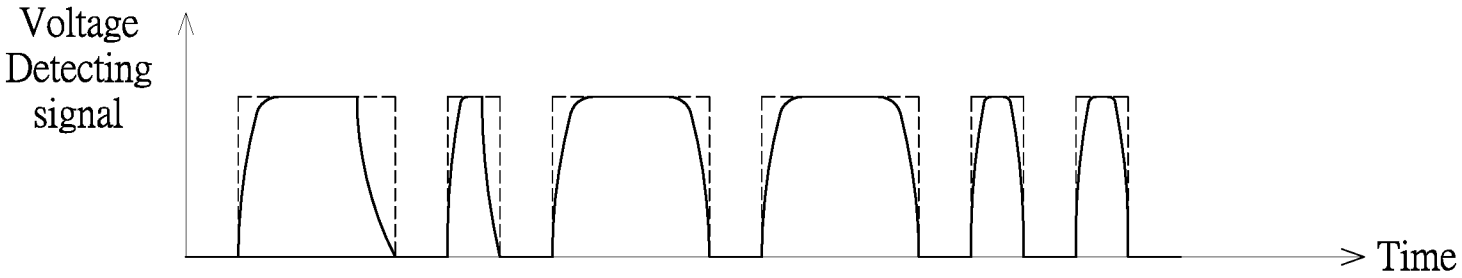
FIG. 6 is a schematic diagram of the compensated detecting signals of the embodiment of the present disclosure.

Referring to FIG. 5A, FIG. 5B and FIG. 6, FIG. 5A is a schematic diagram of the driving signals of a first light emitting diode group of the embodiment of the present disclosure, FIG. 5B is a schematic diagram of the detecting signals of a first light emitting diode group of the embodiment of the present disclosure, and FIG. 6 is a schematic diagram of the compensated detecting signals of the embodiment of the present disclosure.

The waveform of the driving signals in FIG. 5A is the driving signals that are not compensated. The waveform of the detecting signals in FIG. 5B is the detecting signals that are not compensated. As shown in FIG. 5A, the driving signals are square waves, and are distorted according to the resistive character of the light emitting diode module 13'. In the present embodiment, the distortion of the waveform in FIG. 5B denotes that the brightness of the light emitting diode module 13' at the driving time interval ΔT' does not illuminate uniformly.

In the present embodiment, the detecting module 15' detects a voltage difference or a current difference at a predetermined time interval ΔT'. In FIG. 5A and FIG. 5B, the voltage difference is taken as an example. In the present embodiment, the predetermined time interval ΔT' is one picosecond or a number of microseconds. The predetermined time interval ΔT' can be set by a timing unit (not shown) included in the detecting module 15', which is not limited in the present disclosure.

The detecting module 15' provides the first detecting signal of the first light emitting diode group 131', the second detecting signal of the second light emitting diode group 132' and the third detecting single of the third light emitting diode group 133' to the control module 11' based on the voltage difference or the current difference at the predetermined time interval ΔT'. In the present embodiment, the detecting module 15' provides the voltage difference at the driving time interval ΔT' corresponding to the first light emitting diode group 131' or the current difference at the driving time interval ΔT' corresponding to the first light emitting diode group 131' to the control module 11'. That is to say, the voltage of one side of the first light emitting diode module group 131' at each time interval or the current through the first light emitting module group 131' at each time interval is transmitted to the control module 11'. The control module 11' adjusts the corresponding waveform of the first driving signal, so that the voltage waveform or the current waveform of the light emitting diode module 13' detected by the detecting module 15' can be shown as the square waveforms represented by the dotted lines in FIG. 6.

According to the above, the driving circuit of the present disclosure detects the voltage and the current of the light emitting diode module, and provides a detecting signal based on the voltage and the current of the light emitting diode module. The control module adjusts the driving signal based on the detecting signals to enable the light emitting diode module, the light emitting diode group of the light emitting diode or the light emitting diode of the light emitting diode group to illuminate uniformly. Consequently, the control precision of the light emitting diode device can be enhanced, and the LED display device has better performance under different brightness.

The above-mentioned descriptions represent merely the exemplary embodiments of the instant disclosure, without any intention to limit the scope of the instant disclosure thereto. Various equivalent changes, alterations or modifications based on the claims of present disclosure are all consequently viewed as being embraced by the scope of the instant disclosure.

What is claimed is:

1. A driving circuit for driving a light emitting diode module, the driving circuit comprising:

a control module;

a driving module electrically connected to the control module and the light emitting diode module for providing a plurality of driving signals to drive the light emitting diode module; and a detecting module electrically connected to the light emitting diode module and the control module, the detecting module detecting a voltage or a current of the light emitting diode module and transmitting a detecting signal corresponding to a voltage change of the voltage or a current change of the current of the light emitting diode module to the control module, wherein the voltage or the current of the light emitting diode module is distorted;

wherein the control module adjusts a rising time interval or a falling time interval of a waveform of at least one driving signal of the driving signals for driving the light emitting diode module to illuminate uniformly at a driving time interval of the at least one driving signal of the plurality of driving signals according to the voltage change of the voltage or the current change of the current of the light emitting diode module, when the light emitting diode module illuminates uniformly, a waveform of an adjusted voltage or an adjusted current of the light emitting diode module is a square wave.

2. The driving circuit of claim 1, wherein the detecting module further detects a voltage difference at a predetermined time of the light emitting diode module or a current difference at a predetermined time of the light emitting diode module.

3. The driving circuit of claim 2, wherein the predetermined time includes one picosecond or a number of microseconds.

4. The driving circuit of claim 1, wherein the control module comprises:

a compensation unit adjusting the waveform of the at least one driving signal of the driving signals.

5. The driving circuit of claim 1, wherein the control module comprises:

a storage unit storing a plurality of compensation parameters for adjusting the waveforms of the driving signals.

6. An illumination device, comprising:

a light emitting diode module;

a control module;

a driving module electrically connected to the control module and the light emitting diode module for providing a plurality of driving signals to drive the light emitting diode module; and a detecting module electrically connected to the light emitting diode module and the control module, the detecting module detecting a voltage or a current of the light emitting diode module and transmitting a detecting signal corresponding to a voltage change of the voltage or a current change of the current of the light emitting diode module to the control module;

wherein the control module adjusts a rising time interval or a falling time interval of a waveform of at least one driving signal of the driving signals for driving the light emitting diode module to illuminate uniformly at a plurality of driving time interval of the at least one driving signal of the plurality of driving signals according to the voltage change of the voltage or the current change of the current of the light emitting diode module, when the light emitting diode module illuminates uniformly, a waveform of an adjusted voltage or an adjusted current of the light emitting diode module is a square wave.

7. The illumination device of claim 6, wherein the light emitting diode module comprises:

a first light emitting diode group; and a second light emitting diode group;

wherein the driving module provides a plurality of first driving signals and a plurality of second driving signals to drive the first light emitting diode group and the second light emitting diode group, respectively;

wherein the control module adjusts at least one first driving signal of the first driving signals based on a first detecting signal of the first light emitting diode group for adjusting a waveform of at least one first driving signal of the first driving signals, and driving the first light emitting diode module to illuminate uniformly at a driving time interval of an adjusted first driving signal, and the control module adjusts at least one second driving signal of the second driving signals based on a second detecting signal of the second light emitting diode group for adjusting a waveform of at least one second driving signal of the second driving signals, and driving the second light emitting diode module to illuminate uniformly at a driving time interval of an adjusted second driving signal.

* * * * *